US008967153B2

(12) United States Patent
Hoang et al.

(10) Patent No.: US 8,967,153 B2
(45) Date of Patent: Mar. 3, 2015

(54) GLASS CIGARETTE

(76) Inventors: Nam Hoang, San Francisco, CA (US); Eric Tang, Emeryville, CA (US)

( * ) Notice: Subject to any disclaimer, the term of this patent is extended or adjusted under 35 U.S.C. 154(b) by 0 days.

(21) Appl. No.: 13/506,367

(22) Filed: Apr. 16, 2012

(65) Prior Publication Data

US 2013/0269716 A1 Oct. 17, 2013

(51) Int. Cl.
*A24F 1/28* (2006.01)

(52) U.S. Cl.
USPC ..... 131/191; 131/330

(58) Field of Classification Search
CPC ..... A24F 1/28
USPC ..... 131/191
See application file for complete search history.

(56) References Cited

U.S. PATENT DOCUMENTS

| | | | | |
|---|---|---|---|---|
| 4,327,748 | A * | 5/1982 | Divis | 131/187 |
| 6,148,826 | A * | 11/2000 | Lancaster et al. | 131/191 |
| 2008/0023003 | A1 * | 1/2008 | Rosenthal | 128/203.26 |
| 2008/0168998 | A1 * | 7/2008 | Badertscher | 131/365 |

* cited by examiner

*Primary Examiner* — Richard Crispino
*Assistant Examiner* — Eric Yaary
(74) *Attorney, Agent, or Firm* — Donald Grant Kelly

(57) ABSTRACT

A glass cigarette with an elongate hollow tubular borosilicate glass member. The glass member has a first open ended cylindrical smoking material retaining portion, a second cylindrical smoke cooling passage portion and a third tapered tubular mouthpiece portion. A restrictor portion joins the first portion to the second portion. The third tapered portion is contiguous with and fixed to the second portion. The mouthpiece is open ended at the tapered end. A preferred embodiment includes the overall length of the glass cigarette is approximately 106 mm.

3 Claims, 2 Drawing Sheets

GLASS CIGARETTE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable smoking devices and more specifically to a glass cigarette.

Smoking devices are well known. They take the form of cigarettes, cigars and pipes. Various types of smoking substances are used within the smoking device. The primary substance is tobacco.

A smoking pipe allows the user to decide how much smoking substance is introduced at any one time, however, a pipe tends to be somewhat bulky and not capable of easily being carried without needing a carrying bag or case. Cigarettes and cigars are disposable but are of a fixed size and shape and must be stored in a water resistant container.

There are times that a person may want to smoke a small portion of tobacco or other smoking substance, and would like to have a device that is smaller than a traditional pipe for the purpose. Some small metal pipes are available for this type of use, but they tend to produce a metallic taste and also become physically hot during use, and produce smoke that is hot. Additionally, there may be times where a smoker would like to indulge in smoking activity of a very small amount of smoking material and then be able to discard both the ash material and the smoking device. Currently there are no smoking pipes available that are designed to be disposable. Cigarettes and cigars are disposable but they hold a fixed amount of smoking material which may be more than a user is interested in smoking, causing the user to throw out, or to have to store the remaining cigarette or cigar.

BRIEF SUMMARY OF THE INVENTION

The primary object of the invention is to provide a glass cigarette that allows a user to discretely smoke a small amount of smokable material while avoiding the increasingly negative social stigma of smokers and smoking culture.

Another object of the invention is to provide a glass cigarette that provides an efficient low burn rate.

Another object of the invention is to provide a glass cigarette that can be used as a single use item and then thrown out or recycled.

A further object of the invention is to provide a glass cigarette that does not produce any metallic aftertaste.

Yet another object of the invention is to provide a glass cigarette that is easy to maintain and requires no extra parts.

Still yet another object of the invention is to provide a glass cigarette that has improved smoke cooling qualities.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a glass cigarette comprising: an elongate hollow tubular borosilicate glass member, said borosilicate glass member having a first open ended cylindrical smoking material retaining portion, a second cylindrical smoke cooling passage portion, a third tapered tubular mouthpiece portion, a restrictor portion joining said first portion to said second portion, said third tapered portion contiguous with and fixed to said second portion, and said mouthpiece being open ended at said tapered end.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
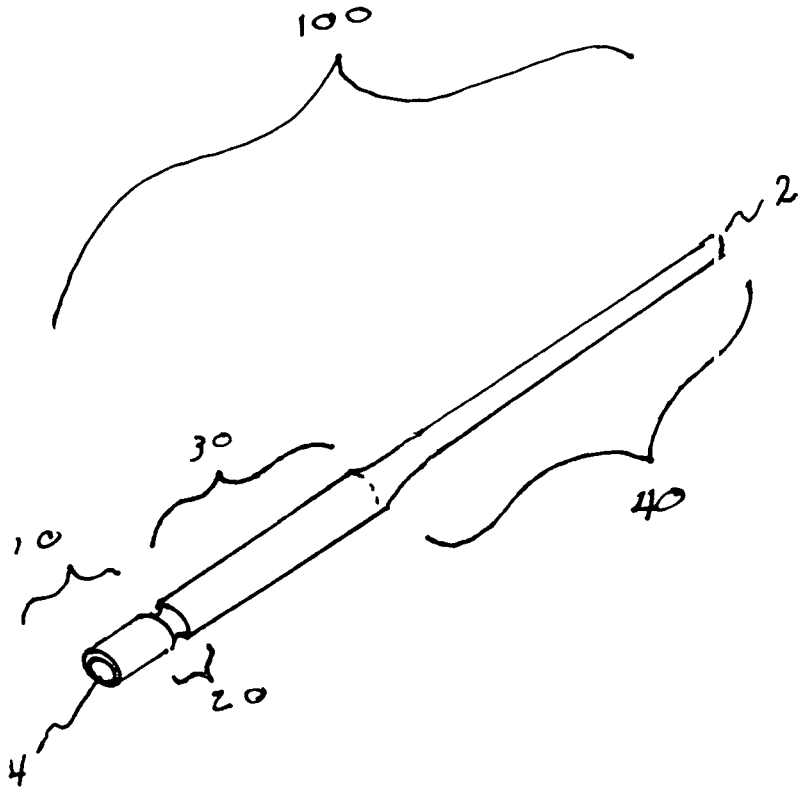
FIG. 1 is a perspective view of the glass cigarette of the invention.

FIG. 1 is a perspective view of the glass cigarette of the invention 100. It is basically an elongate tubular device which has a first open ended 4 smoking material holding portion 10, a second central smoke cooling portion 30 and a third mouthpiece portion 40. There is a restrictor portion 20 positioned between and joining the smoking material holding portion 10 and the smoke cooling portion 30. In the preferred embodiment, the invention 100 is made from borosilicate glass, which is heat resistant. However, the device 100 can also be made of flit/soda lime glass. A smoking substance is placed in the first smoking material holding portion 10 and is prevented from entering the central portion by restrictor portion 20. The user inputs tip 2 into his or her mouth and applies a flame type lighting device to the open end 4. When the user inhales the smoke, it traverses inner smoke passage 8 into the central section 30 where it cools and then travels through tapered mouthpiece portion 40. The thin taper of mouthpiece portion 40 helps restrict the amount of airflow coming to the user, as well as providing additional surface area for cooling, thus producing a low temperature and controlled inhalation smoking experience.

Figure 2:
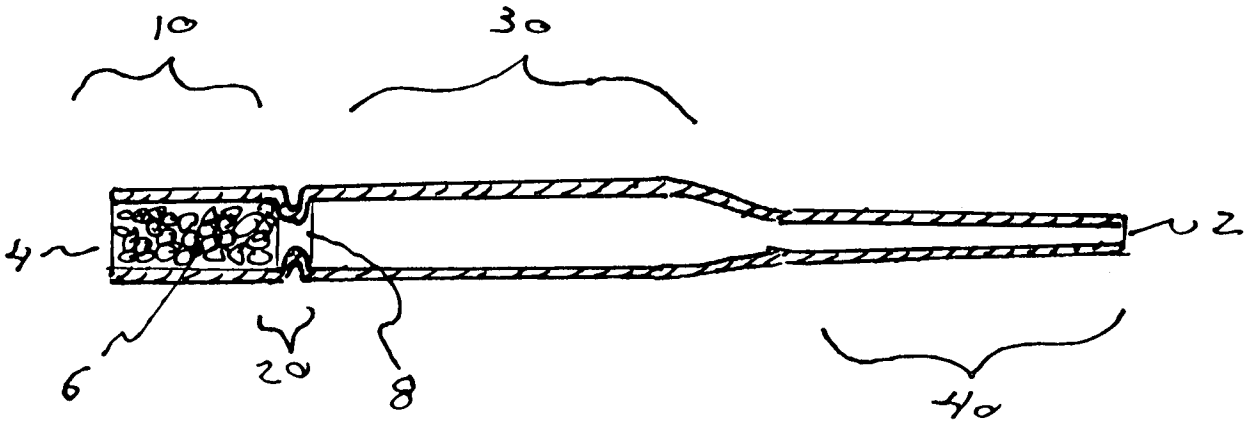
FIG. 2 is a side section view of the invention.

FIG. 2 is a side section view which bisects the invention 100. Smoking substance 6 can be clearly seen packed into the smoking material holding portion 10. The dimensions of the present invention 100 are important to the ideal working conditions of the invention 100 and therefore will be now described in full. The smoking material holding portion 10 is approximately eighteen millimeters long and has an inside diameter of approximately five millimeters and an outside diameter of approximately six millimeters. The small inside diameter of the smoking material holding portion 10 is small enough to create an extinguishing effect on the material as to minimize wasted burning. The restrictor portion 20 restricts the inside diameter to approximately four millimeters thus defining inner smoke passage 8 measuring approximately 80% of said inside diameter of said first and second portions. This configuration eliminates the necessity for a screen, which is found in many other smoking devices. The cooling portion 30 returns to the same diameter as the smoke material chamber portion 10. The smoke cooling portion 30 is approximately thirty-eight millimeters long. The mouthpiece portion 40 is approximately fifty millimeters long and tapers to a thin open end with an inside diameter of one millimeter and an outside diameter of approximately two millimeters at its tapered end exit point 2 of the invention 100. The overall length is approximately one-hundred and six millimeters. The wall thickness of the elongate hollow tubular glass member is approximately one half of one millimeter. This thin wall thickness also increases the cooling effect of the invention because this allows the glass to cool more quickly between uses. It is important to note that the above mentioned dimensions are approximate, however, they do represent an ideal working configuration that is small enough to be easily carried in a pocket or purse.

The present invention 100 is a clean, discrete, practical and highly efficient glass smoking instrument that eliminates the need for expensive smoking equipment. Because of the simple one piece construction, the invention 100 is economical and can even be disposed of after one time use device. The invention 100 allows the user to engage in the activity of smoking while avoiding the increasingly negative social stigma of smokers and smoking culture.

The inside dimensions of the present invention 100 produce a low burn rate which efficiently and completely makes use of expensive smoking material. The single use option for the invention 100 means that the user does not have to clean dirty equipment after use if so desired. The user has the option to load the smoking material retaining portion 10 in advance and carry the entire assembly easily in a pocket or purse, eliminating the need to fill a pipe. The borosilicate glass construction provides a clean, smooth, cool taste in comparison to metal pipes that produce metallic tasting, hot smoke. In comparison to a standard cigarette, there is no wasted smoking material that is inevitable in the remaining portion of the cigarette closest to the user's mouth. The relatively low heat conductivity of glass means that the user can hold the glass cigarette 100 without danger of burning his or her fingers.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A glass cigarette wherein said glass cigarette is made from borosilicate glass, and further defined as:

an elongate hollow tubular glass member;

said glass member having a first open ended cylindrical smoking material retaining portion;

said glass member further having a second cylindrical smoke cooling passage portion;

said first open ended cylindrical smoking material retaining portion and said second cylindrical smoke cooling passage portion having an outer and inner diameter;

a third tapered tubular mouthpiece portion;

a restrictor portion joining said first portion to said second portion, said restrictor portion preventing said smoking material in said first portion from entering said second portion;

said third tapered mouthpiece portion contiguous with and fixed to said second portion;

and said mouthpiece portion having an open tapered end;

the overall length of said glass cigarette is approximately 106 mm;

said first cylindrical portion is approximately 18 mm long;

said second cylindrical portion is approximately 38 mm long;

said third tapered mouthpiece portion has a thin open end and is approximately 50 mm long;

said outside diameter of said first and second cylindrical portions being approximately 6 mm;

said inside diameter of said first and second cylindrical portions being approximately 5 mm;

the outside diameter of the thin open end of said third tapered mouthpiece portion being approximately 2 mm;

the inside diameter of said thin open end of said third tapered mouthpiece portion being approximately 1 mm.

2. A glass cigarette as claimed in claim 1 wherein said inside diameter of said restrictor portion is approximately 4 mm.

3. A glass cigarette comprising:

an elongate hollow tubular glass member;

said glass member having a first open ended cylindrical smoking material retaining portion;

said glass member further having a second cylindrical smoke cooling passage portion;

said first open ended cylindrical smoking material retaining portion and said second cylindrical smoke cooling passage portion having an outer and inner diameter;

a third tapered tubular mouthpiece portion;

a restrictor portion joining said first portion to said second portion, said restrictor portion preventing said smoking material in said first portion from entering said second portion;

said third tapered mouthpiece portion contiguous with and fixed to said second portion;

and said mouthpiece portion having an open tapered end;

wherein said hollow tubular glass member has a wall thickness of approximately 0.5 mm.

* * * * *